US005134684A

United States Patent [19]

Mishou et al.

[11] Patent Number: 5,134,684

[45] Date of Patent: Jul. 28, 1992

[54] ELECTRIC AIR OR GAS HEATER UTILIZING A PLURALITY OR SERPENTINE HEATING ELEMENTS

[75] Inventors: Joan L. Mishou, Portsmouth; Jonathan B. Arold, Exeter; Charles R. Parent, Durham; Joseph P. Stark, New Market; Edward A. Webb, Wolfeboro, all of N.H.

[73] Assignee: GTE Products Corporation, Stamford, Conn.

[21] Appl. No.: 526,274

[22] Filed: May 21, 1990

[51] Int. Cl.[5] ..... H05B 3/00; F24H 1/10

[52] U.S. Cl. ..... 392/486; 392/379; 392/473

[58] Field of Search ..... 392/488, 492, 493, 473, 392/485, 486, 487, 473, 379

[56] References Cited

U.S. PATENT DOCUMENTS

| | | | |
|---|---|---|---|
| Re. 23,795 | 3/1954 | Cartinhour | 392/492 |
| 2,797,297 | 6/1957 | Nihlen | 392/492 |
| 3,551,643 | 12/1970 | Pricenski et al. | 392/488 |
| 3,598,538 | 8/1971 | Peacock | 392/493 |
| 3,654,431 | 4/1972 | Brooks et al. | 392/473 |
| 3,783,236 | 1/1974 | Edin | 392/488 |
| 4,233,494 | 11/1980 | Pawlik | 392/488 |

FOREIGN PATENT DOCUMENTS

| | | | |
|---|---|---|---|
| 125084 | 3/1928 | Switzerland | 392/486 |
| 174737 | 9/1965 | U.S.S.R. | 392/485 |

*Primary Examiner*—Anthony Bartis

*Attorney, Agent, or Firm*—James Theodosopoulos

[57] ABSTRACT

An electric air or gas heater includes a plurality of equal diameter elongated linear serpentine resistive wire heating elements circularly arranged in parallel about a common axis and disposed within a cylindrical chamber having separable air or gas entrance and exit sections at its opposite ends. Each heating element is disposed in a close-fitting ceramic or quartz tube. The tubes are supported by discs at the opposite ends of the chamber which block air or gas flow outside the cross-sectional area of the tubes. Each heating element has a ceramic cylinder extending through the center thereof through which a wire for electrically connecting adjacent pairs of heating elements extends.

4 Claims, 3 Drawing Sheets

3
23
24
30
22

4
27
27
2
13
8
7
11
28
14
28
6
15
11
15
10
9
26
6
23
12
17
3
31
30
22
19

ELECTRIC AIR OR GAS HEATER UTILIZING A PLURALITY OR SERPENTINE HEATING ELEMENTS

This invention concerns forced air or gas heaters. Examples thereof are shown in U.S. Pat. No. 3,783,236, 3,654,431 and 3,551,643.

Such heaters utilize electric heating elements made of resistance wire. The maximum temperature that air or gas can be heated to in such heaters is limited by the maximum temperature that the resistance wire can be heated to. This invention concerns a heater utilizing serpentine heating elements that permits air or gas to be heated to a higher temperature than prior art heaters utilizing serpentine heating elements. Serpentine heating elements are disclosed in the above-mentioned patents. A serpentine heating element comprises a length of coiled resistance wire, the individual turns of the coil having a substantially polygonal shape and being radially displaced from adjacent turns.

In this invention, instead of one serpentine heating element in the chamber through which the air passes to be heated, as in the above-mentioned patents, there are a plurality of equal-diameter serpentine heating elements, circularly arranged around an axis, as shown in FIG. 4, and in parallel with each other. The reason why such an arrangement permits a higher air exit temperature than in the case of a single serpentine heating element is related to the nature of the serpentine winding and to the fact that the diameter of the single element is larger than the diameter of the plural elements. The turns of a smaller diameter element present more obstruction to air flowing there through than do the turns of a larger diameter element. Therefore, heat transfer from the smaller diameter heating element to the air is increased.

In the drawing,

FIG. 1 is a perspective and

FIG. 2 an exploded perspective of a heater in accordance with this invention.

Figure 1:
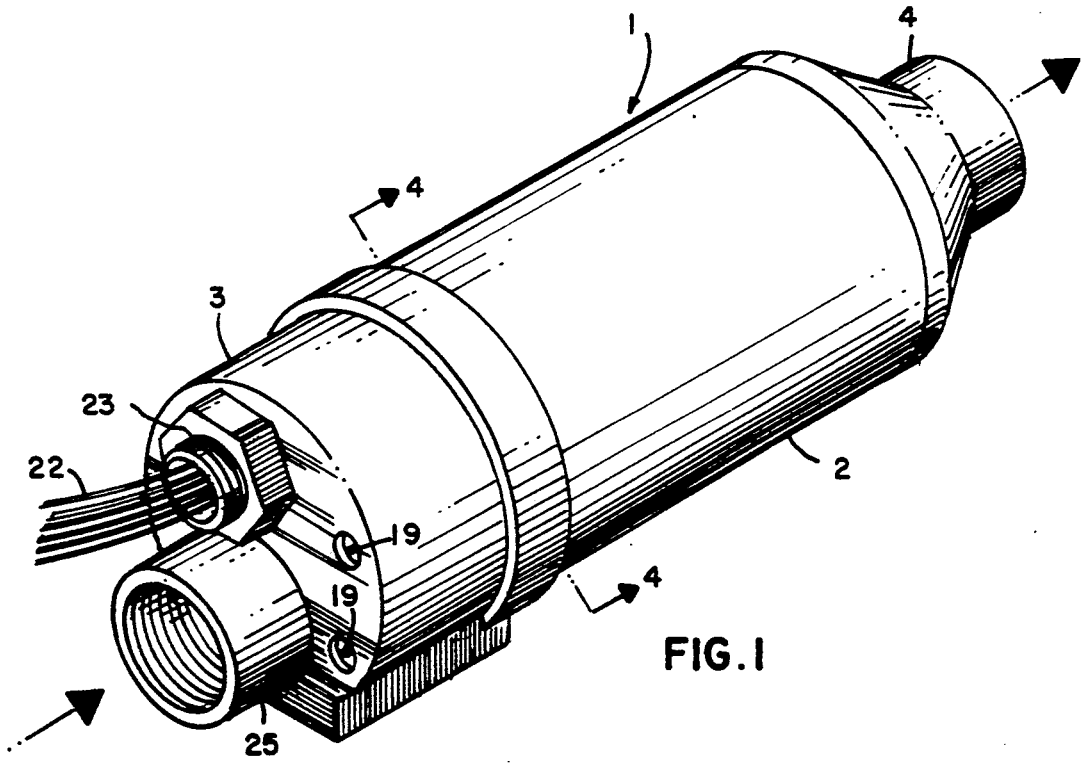

As shown in the drawing, a heater 1 in accordance with this invention comprises a cylindrical chamber 2, an entrance section 3 and an exit section 5. Air or gas to be heated enters at entrance section 3, passes through serpentine heating elements 5 within chamber 2 and out exit section 4. Preferably, chamber 2, entrance section 3 and exit section 4 are made of stainless steel.

Figures 2, 3:
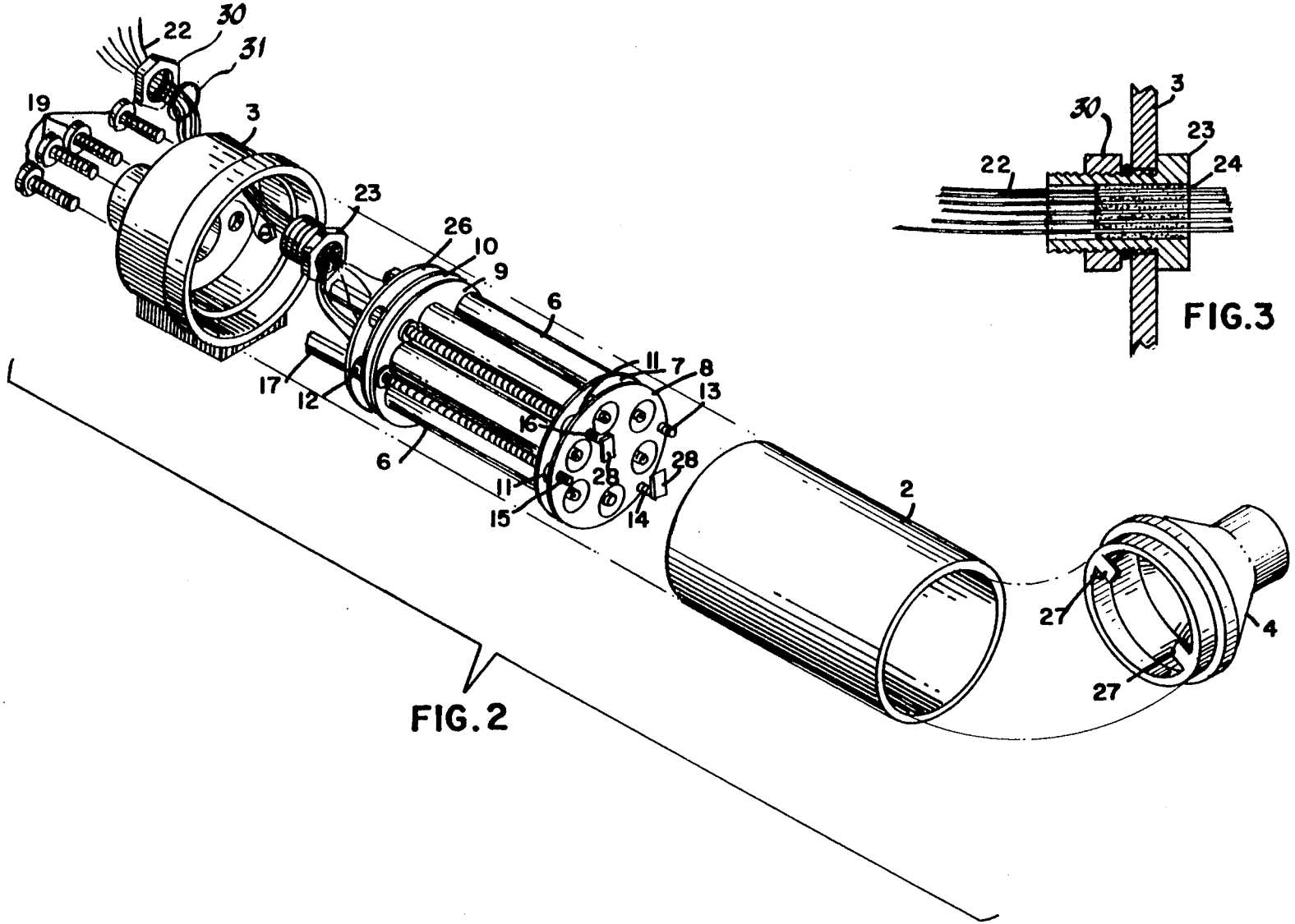
FIG. 3 is a cross-section of the electrical conduit portion of the heater.
Figure 4:
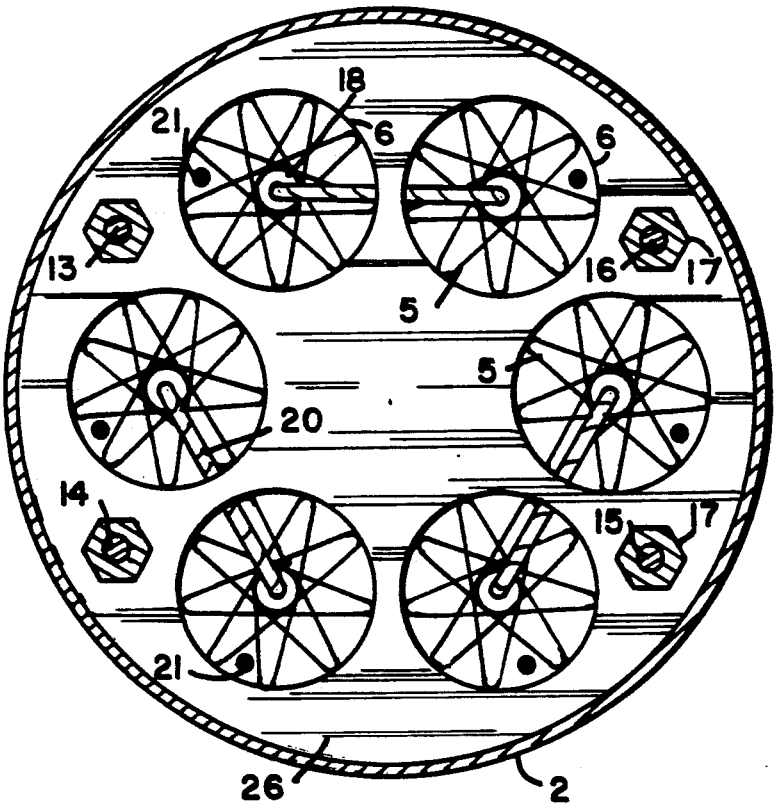
FIG. 4 is a cross-section of the chamber containing the serpentine heating elements.

In the embodiment shown in FIGS. 2 and 4 there were six serpentine heating elements 5, each disposed within a ceramic or quartz tube 6. The inside diameter of each ceramic tube 6 was 15/16" and the diameter of each serpentine heating element was very slightly less, so that each serpentine heating element 5 was a close fit within ceramic tube 6. The six serpentine heating elements 5 were circularly located on a 2 9/16" diameter circle. The inside diameter of chamber 2 was 3 7/8".

Ceramic tubes 6 were held in place by means of circular metal discs 7, 8, 9 and 10. Discs 7 and 8 were located at the exit end of tubes 6 and discs 9 and 10 were located at the entrance end of tubes 6. Discs 7 and 9 had six slightly oversize holes so that tubes 6 could fit through them. Discs 8 and 10 had six slightly undersize holes so that the ends of tubes 6 butted against discs 8 and 10.

Discs 7 and 8 were spaced apart by nuts 11. Discs 9 and 10 were spaced apart by ceramic spacers (not shown). The discs were held in place by means of four threaded rods 13, 14, 15 and 16. The four rods passed through nuts 11 and the ceramic spacers. The four rods were welded to disc 8. Disc 7 was secured against nuts 11 by nuts (now shown) on the four rods, two of which were welded to the rods that they were on in order to prevent loosening. At the entrance end of tubes 6 there was an insulating disc 26 made of mica. Disc 26 was spaced from disc 10 by ceramic spacers 12. Disc 26 had holes in alignment with tubes 6 in order to permit the air to flow through serpentine heating elements 5. Disc 26 and disc 10 substantially blocked flow outside the cross-section area of serpentine heating elements 5. The four rods extended through holes in disc 26. Threaded metal standoffs 17 were threaded on the inlet ends of rods 13, 14, 15 and 16 and secured discs 26, 10 and 9 against each other. Entrance section 3 was secured by means of four screws 19 which were screwed into standoffs 17.

Each serpentine heating element 5 had a ceramic cylinder 18 extending through the center thereof. The far ends (exit ends), as seen in FIG. 4, of two adjacent serpentine heating elements 5 were electrically connected by means of an electrically connecting wire 20 extending through a ceramic cylinder 18 of one serpentine heating element 5, crossing over and extending through ceramic cylinder 18 of the adjacent serpentine heater element 5. Thus two adjacent serpentine heating elements 5 were in series. This arrangement of three sets of two serpentine heating elements 5 in series provides great flexibility in the type of electrical supply that can be brought thereto, such as single phase, series, parallel, three phase, wye, delta, etc. Electrical connection as made to near ends 21 of heating elements 5 by means of wires 22 extending through conduit 23 in entrance section 3. Wires 22 were embedded in conduit 23 by a potting material 24, for example, epoxy resin. Air enters entrance section 3 through threaded inlet 25.

A comparison was made between a single three inch diameter serpentine heating element and six half-inch diameter serpentine heating elements circularly arranged as per this invention to a diameter of three inches. The maximum air temperature attainable for the single element for a hot-spot element temperature of 1950° F. was 800° F. In the case of the six circularly arranged elements the maximum air temperature attainable for a hot-spot element temperature of 1950° F. was 1590° F., almost double.

Exit section 4 is secured by inserting it into chamber 2 and them twisting it until projections 27 on exit section 4 are in alignment with, and under, projections 28 which are welded to the ends of rods 14 and 16. Then, tightening of standoffs 17 at the other ends of rods 14 and 16 tightens projections 28 against projections 27 and locks exit section 4 in place.

We claim:

1. A electric heater for heating air or gas comprising a plurality of equal diameter elongated linear serpentine heating elements made of resistance wire, the serpentine heating elements being circularly arranged around a common axis and in parallel with each other and disposed within a cylindrical chamber, the chamber having an entrance section at one end thereof and an exit section at its opposite end, means within the entrance section to direct air or gas flow through the serpentine heating elements and to substantially block flow outside the cross-section area of the serpentine heating elements, means to supply electrical power to the serpentine heating elements, means associated with such heating elements to direct the air or gas being heated in a straight-through path through said cylindrical chamber so that said air or gas enters said cylindrical chamber at the entrance section and exits said cylindrical chamber at the exit section at the opposite end, the entrance and exit sections being separable from the cylindrical chamber, each serpentine heating element being disposed within a close-fitting tube, the tubes being supported by discs at the entrance and exit ends thereof, the tubes fitting within slightly oversize holes in the discs, the entrance and exit ends of the tubes abutting against other discs, the other discs having slightly undersize holes in alignment with the serpentine heating elements.

2. The electric heater of claim 1 wherein there are four threaded rods in parallel with the tubes and which extend through all the discs and which secure the assembly of tubes and discs.

3. The electric heater of claim 2 wherein two of the threaded rods have projections fastened to the exit ends thereof and wherein the exit section of the hater has two similar projections thereon and wherein the exit section of the heater is secured by locking its projections behind the projections on the ends of the threaded rods.

4. The electric heater of claim 2 wherein there are threaded standoffs fastened to the entrance ends of the threaded rods and wherein the entrance section of the heater is secured by means of screws through the entrance section which screw into the threaded standoffs.

* * * * *